US009476157B2

(12) United States Patent
Park et al.

(10) Patent No.: US 9,476,157 B2
(45) Date of Patent: Oct. 25, 2016

(54) DRAIN HOSE AND WASHER HAVING THE SAME

(75) Inventors: Sang Ho Park, Hwaseong-si (KR); Doo Young Ryu, Suwon-si (KR); Chan Woo Park, Anyang-si (KR); John Ha Park, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1318 days.

(21) Appl. No.: 13/343,150

(22) Filed: Jan. 4, 2012

(65) Prior Publication Data

US 2012/0167931 A1 Jul. 5, 2012

(30) Foreign Application Priority Data

Jan. 5, 2011 (KR) ..... 10-2011-0001066
Feb. 18, 2011 (KR) ..... 10-2011-0014574

(51) Int. Cl.
*D06F 39/08* (2006.01)
*A47L 15/42* (2006.01)

(52) U.S. Cl.
CPC ..... *D06F 39/083* (2013.01); *A47L 15/4223* (2013.01)

(58) Field of Classification Search
CPC ..... D06F 39/083
See application file for complete search history.

(56) References Cited

U.S. PATENT DOCUMENTS 3,349,805 A 10/1967 Fried
5,312,138 A 5/1994 Patera et al.
5,704,401 A 1/1998 Fukui et al.
7,454,928 B2 * 11/2008 Houser et al. ..... 68/23.1
2009/0266427 A1 * 10/2009 Haltmayer et al. ..... 137/343
2010/0095713 A1 * 4/2010 Yim et al. ..... 68/19

FOREIGN PATENT DOCUMENTS

| | | | | |
|---|---|---|---|---|
| CN | 1534131 | | 10/2004 | |
| CN | 1755019 | | 4/2006 | |
| CN | 101346507 | | 1/2009 | |
| EP | 1 201 981 | | 10/2001 | |
| EP | 1201981 | A1 * | 5/2002 | ..... F16L 11/11 |
| EP | 1 462 561 | | 6/2003 | |
| EP | 1 956 263 | | 2/2007 | |
| EP | 1956263 | A1 * | 8/2008 | ..... A47L 15/42 |
| KR | 20-1993-0008882 | | 5/1993 | |
| KR | 10-1999-0045022 | | 6/1999 | |
| KR | 10-2004-0079624 | * | 9/2004 | |
| KR | 10-2004-0084150 | | 10/2004 | |

(Continued)

OTHER PUBLICATIONS

Extended European Search Report issued Oct. 7, 2013 in corresponding European Application No. 11 19 5838.

(Continued)

*Primary Examiner* — Michael Barr
*Assistant Examiner* — Jason Riggleman
(74) *Attorney, Agent, or Firm* — Staas & Halsey LLP

(57) ABSTRACT

A drain hose has a simple structure which absorbs vibration of a drain pump, and a washer has the same. The washer includes a main body, a drain pump disposed at the lower portion of the main body, a drain hose to guide wash water pumped by the drain pump to the outside of the main body, and an anti-vibration member formed of a material differing from the drain hose, and including a corrugation part connected between the drain pump and the drain hose and absorbing vibration of the drain pump during drainage of the wash water.

32 Claims, 14 Drawing Sheets

(56) References Cited

FOREIGN PATENT DOCUMENTS

| | | |
|---|---|---|
| KR | 10-2004-0047713 | * 12/2005 |
| KR | 10-2006-0085834 | 7/2006 |
| KR | 10-2006-0115482 | 11/2006 |
| KR | 10-2008-0065765 | 7/2008 |
| KR | 10-2008-0088175 | 10/2008 |
| KR | 10-2010-0082448 | 7/2010 |
| KR | 10-2010-106575 | 10/2010 |

OTHER PUBLICATIONS

Chinese Office Action issued Feb. 16, 2015 in corresponding Chinese Patent Application No. 201210005651.0.

Korean Patent Office Action issued in Korean Patent Application No. 10-2011-0014574 dated May 31, 2015 (17 total pages).

Chinese Patent Second Office Action issued in Chinese Patent Application No. 201210005651.0 dated Aug. 17, 2015 (19 total pages).

Korean Patent Notice of Patent Allowance issued in Korean Patent Application No. 9-5-2015-070658514 dated Oct. 14, 2015 (7 total pages).

"Yearbook of Reconstruction of Existing Buildings (2010)", Editorial Board of Yearbook of Reconstruction of Existing Buildings, pp. 143-144, China Building Industry Press, Nov. 2010, ISBN 978-7-112-12480-0 (total 7 pages).

Korean Office Action issued Aug. 19, 2014 in corresponding Korean Patent Application No. 10-2011-0014574.

* cited by examiner

DRAIN HOSE AND WASHER HAVING THE SAME

CROSS-REFERENCE TO RELATED APPLICATIONS

This application claims the benefit of Korean Patent Application No. 2011-0001066, filed on Jan. 5, 2011, and No. 2011-0014574, filed on Feb. 18, 2011 in the Korean Intellectual Property Office, the disclosure of which is incorporated herein by reference.

BACKGROUND

1. Field

Embodiments relate to a drain hose which reduces vibration noise generated from a drain pump, and a washer having the same.

2. Description of the Related Art

In general, a washer, such as a washing machine or a dish washer, executes a washing process of laundry or dishes using water supplied from the outside.

Water used to execute the washing process is pumped by a drain pump, and is forcibly drained to the outside of the washer through a drain hose connected to the drain pump.

The drain hose is fixed to a frame of the washer by a holder or a guide, and vibration generated from the drain pump during operation of the drain pump is transmitted along the drain hose connected to the drain pump and thus causes vibration noise of the frame to which the drain hose is fixed. Therefore, a structure preventing vibration generated from the drain pump during operation of the drain pump from being transmitted to the drain hose is required.

SUMMARY

Therefore, it is an aspect to provide a drain hose having a simple structure which may absorb vibration of a drain pump, and a washer having the same.

Additional aspects of the invention will be set forth in part in the description which follows and, in part, will be obvious from the description, or may be learned by practice of the invention.

In accordance with one aspect, a washing machine may include a cabinet including a frame, a tub disposed within the cabinet to accommodate laundry, a drain pump connected to the lower surface of the frame to drain wash water in the tub, a drain hose to guide wash water pumped by the drain pump to the outside of the cabinet, and an anti-vibration member connected between the drain pump and the drain hose, serving as a path along which wash water is drained, and preventing vibration of the drain pump from being transmitted to the drain hose during drainage of the wash water.

The anti-vibration member may include a first connection part connected to the drain pump, a second connection part connected to the drain hose and a corrugation part provided between the first connection part and the second connection part.

The anti-vibration member and the drain hose may be formed of different materials.

The drain pump may include a wash water inlet through which wash water in the tub is introduced into the drain pump and a wash water outlet to discharge the wash water introduced into the drain pump, and the first connection part may extend from one end of the corrugation part and be connected to the wash water outlet.

The drain hose may include a hose corrugation part allowing the drain hose to be flexibly bent and an extension part extending from one end of the hose corrugation part, and the second connection part may extend from the other end of the corrugation part and be connected to the extension part.

The second connection part and the extension part may be connected to each other by heat fusion.

The anti-vibration member may include a sleeve connected to the second connection part.

The sleeve may include an insertion part inserted into the second connection part to reinforce the second connection part and a latching part formed at the end of the insertion part to restrict a depth of the sleeve inserted into the second connection part.

The second connection part may be inserted into one end of the drain hose.

The anti-vibration member may be formed of an injection molded product of plastic or rubber.

The anti-vibration member may be formed integrally with the drain hose.

The first connection part may have a size corresponding to the diameter of the wash water outlet and the second connection part may have a size corresponding to the diameter of the extension part so as to use the anti-vibration member in common.

The washing machine may further include a remaining water hose to guide wash water remaining in the drain pump to the outside of the cabinet and an anti-vibration member including a corrugation part connected between the drain pump and the remaining water hose and preventing vibration of the drain pump from being transmitted to the remaining water hose during drainage of the wash water.

In accordance with another aspect, a washing machine may include a cabinet including a front frame and a rear frame, a tub disposed within the cabinet to accommodate laundry, a drain pump disposed below the tub to drain wash water in the tub, a drain hose to guide wash water pumped by the drain pump to the outside of the cabinet, and an anti-vibration member formed of a material differing from the drain hose, and including a corrugation part connected between the drain pump and the drain hose and absorbing vibration of the drain pump during drainage of the wash water.

The drain pump may be disposed closer to the front frame than the rear frame.

The anti-vibration member may further include a first connection part connected to the drain pump and a second connection part connected to the drain hose.

The anti-vibration member may further include a strength reinforcing member connected to the second connection part, and the strength reinforcing member may include an insertion part inserted into the second connection part to reinforce the second connection part and a latching part formed at the end of the insertion part to latch the strength reinforcing member to one end of the second connection part.

The anti-vibration member may be formed of an injection molded product of plastic or rubber.

The cabinet may further include side frames and a lower frame connecting the front frame and the rear frame to each other, and the washing machine may further include an anti-vibration pad connected to the inner surface of at least one of the frames to prevent the drain hose from directly contacting the frames due to vibration of the drain pump.

In accordance with another aspect, a dish washer may include a case, a washing tub disposed in the case to accommodate dishes, a sump provided under the washing tub, a drain pump provided at one end of the sump to drain wash water in the sump, a drain hose to guide wash water pumped by the drain pump to the outside of the case, and an anti-vibration member connected between the drain pump and the drain hose, serving as a path along which wash water is drained, and preventing vibration of the drain pump from being transmitted to the drain hose during drainage of the wash water.

The anti-vibration member may include a first connection part connected to the drain pump, a second connection part connected to the drain hose and a corrugation part provided between the first connection part and the second connection part.

The anti-vibration member and the drain hose may be formed of different materials.

The drain pump may include a wash water inlet through which wash water in the sump is introduced into the drain pump and a wash water outlet to discharge the wash water introduced into the drain pump, and the first connection part may extend from one end of the corrugation part and be connected to the wash water outlet.

The drain hose may include a hose corrugation part allowing the drain hose to be flexibly bent and an extension part extending from one end of the hose corrugation part, and the second connection part may extend from the other end of the corrugation part and be connected to the extension part.

The second connection part and the extension part may be connected to each other by heat fusion.

The anti-vibration member may include a sleeve connected to the second connection part.

The sleeve may include an insertion part inserted into the second connection part to reinforce the second connection part, and a latching part formed at the end of the insertion part to restrict a depth of the sleeve inserted into the second connection part.

The second connection part may be inserted into one end of the drain hose.

The anti-vibration member may be formed of an injection molded product of plastic or rubber.

The anti-vibration member may be formed integrally with the drain hose.

The first connection part may have a size corresponding to the diameter of the wash water outlet and the second connection part may have a size corresponding to the diameter of the extension part so as to use the anti-vibration member in common.

In accordance with another aspect, a drain hose connected to a drain pump to forcibly drain wash water accommodated in a tub of a washing machine to the outside of the washing machine, includes a hose corrugation part extensible in the lengthwise direction of the drain hose, and an extension part extending from one end of the hose corrugation part, wherein the hose corrugation part and the extension part are formed of different materials, and an anti-vibration member including a corrugation part to absorb vibration of the drain pump is provided.

The anti-vibration member and the extension part may be connected to each other by heat fusion.

The anti-vibration member may include a strength reinforcing member to reinforce the anti-vibration member to connect the anti-vibration member and the extension part to each other by heat fusion, and the strength reinforcing member may include an insertion part inserted into one end of the anti-vibration member, and a latching part bent outwards from the end of the insertion part so as to latch the strength reinforcing member to the end of the anti-vibration member.

In accordance with a further aspect, a washer may include a main body, a drain pump disposed at the lower portion of the main body, a drain hose to guide wash water pumped by the drain pump to the outside of the main body, and an anti-vibration formed of a material differing from the drain hose, and including a corrugation part connected between the drain pump and the drain hose and absorbing vibration of the drain pump during drainage of the wash water.

The anti-vibration member may include a first connection part connected to the drain pump and a second connection part connected to the drain hose.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
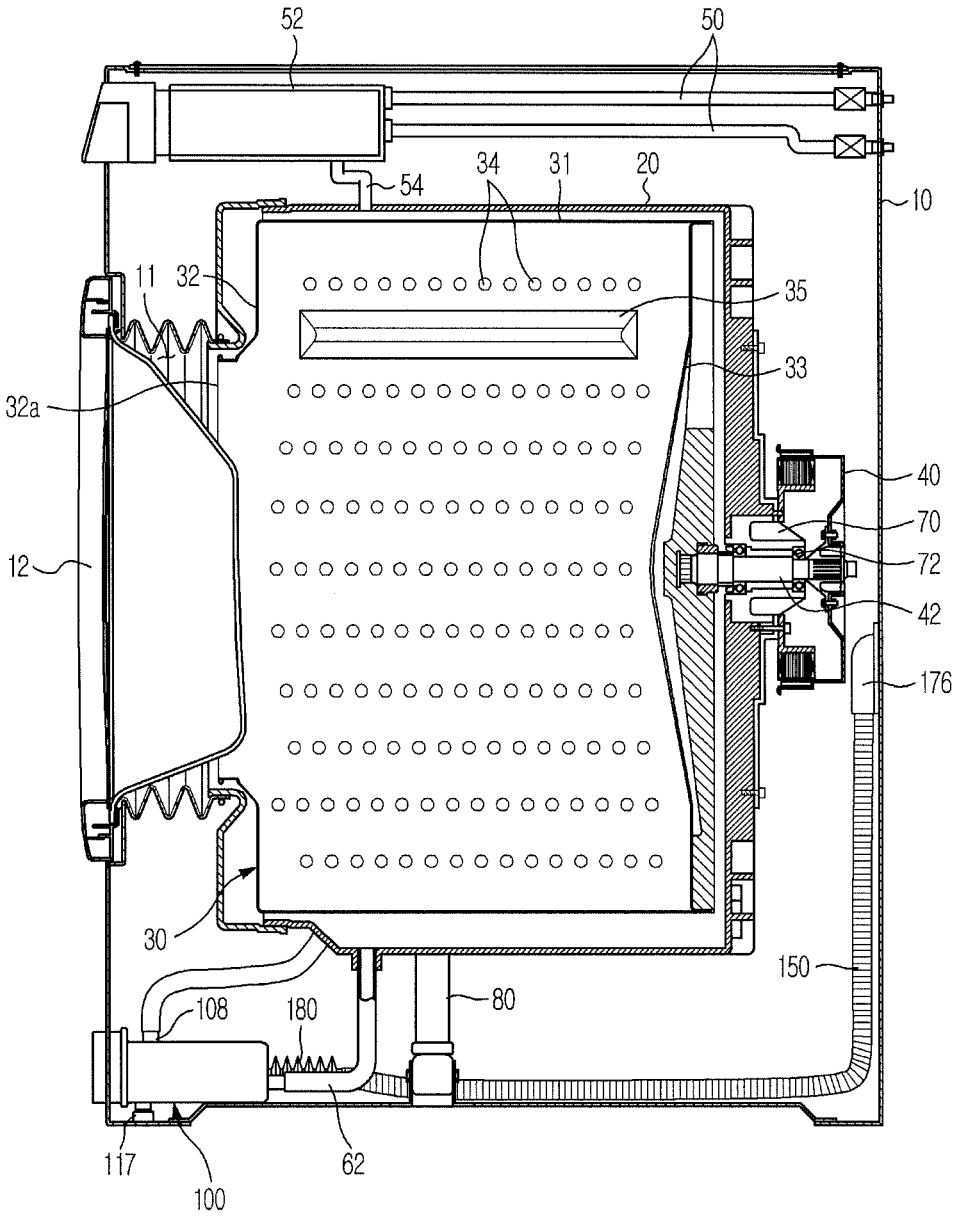
FIG. 1 is a sectional view illustrating the configuration of a washing machine in accordance with one embodiment.

Reference will now be made in detail to the embodiments, examples of which are illustrated in the accompanying drawings, wherein like reference numerals refer to like elements throughout.

From among representative washers, a washing machine will be first described, and then a dish washer will be described.

FIG. 1 is a sectional view illustrating the configuration of a washing machine in accordance with one embodiment.

As shown in FIG. 1, a washing machine 1 in accordance with this embodiment may include a cabinet 10 forming the external appearance of the washing machine 1, a tub 20 disposed within the cabinet 10, a drum 30 rotatably disposed within the tub 20, and a motor 40 to drive the drum 30.

The cabinet 10 may include frames 10*a*, 10*b*, 10*c* and 10*d*, and the frames 10*a*, 10*b*, 10*c* and 10*d* may include a front frame 10*a* and a rear frame 10*b* forming front and rear surfaces of the cabinet 10, and side frames 10*c* and a lower frame 10*d* connecting the front frame 10*a* to the rear frame 10*b* and forming side and lower surfaces of the cabinet 10.

An inlet 11 through which laundry is put into the drum 30 may be formed on the front surface of the cabinet 10. The inlet 11 may be opened and closed by a door 12 installed on the front surface of the cabinet 10.

Water supply pipes 50 to supply wash water to the tub 20 may be installed above the tub 20. One end of each water supply pipe 50 may be connected to an external water supply source (not shown), and the other end of each water supply pipe 50 may be connected to a detergent supply device 52.

The detergent supply device 52 may be connected to the tub 20 through a connection pipe 54. Water supplied through the water supply pipe 50 may be supplied to the detergent supply device 52 and may be mixed with a detergent in the detergent supply device 52, and then the water containing the detergent may be supplied to the inside of the tub 20.

The tub 20 may be supported by a damper 80. The damper 80 may connect the inner lower surface of the cabinet 10 to the outer surface of the tub 20.

The drum 30 may include a cylindrical member 31, a front plate 32 disposed at the front portion of the cylindrical member 31, and a rear plate 33 disposed at the rear portion of the cylindrical member 31. An opening 32*a* through which laundry is put into the drum 30 may be formed on the front plate 32, and a drive shaft 42 to transmit power of the motor 40 may be connected to the rear plate 33.

A plurality of through holes 34 to circulate wash water may be formed through the circumferential surface of the drum 30, and a plurality of lifters 35 to raise and drop the laundry when the drum 30 is rotated may be installed on the inner surface of the drum 30.

The drive shaft 42 may be disposed between the drum 30 and the motor 40. One end of the drive shaft 42 may be connected to the rear plate 33 of the drum 30, and the other end of the drive shaft 42 may extend outwards from the rear wall of the tub 20. When the motor 40 drives the drive shaft 42, the drum 30 connected to the drive shaft 42 may be rotated around the drive shaft 42.

A bearing housing 70 to rotatably support the drive shaft 42 may be installed on the rear wall of the tub 20. The bearing housing 70 may be formed of an aluminum alloy and be inserted into the rear wall of the tub 20 during injection molding of the tub 20. Bearings 72 may be installed between the bearing housing 70 and the drive shaft 42 so as to effectively rotate the drive shaft 42.

Figure 2:
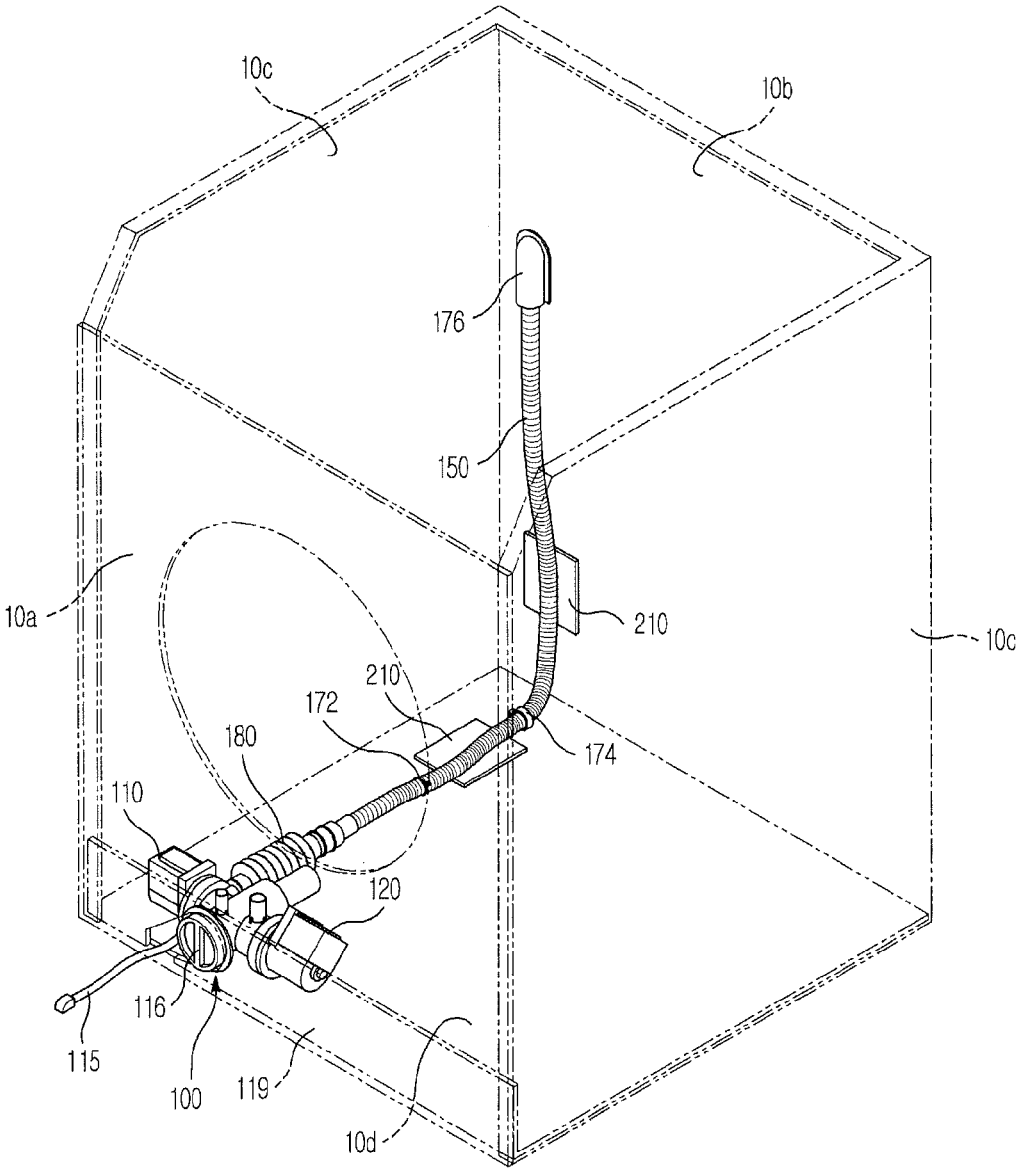
FIG. 2 is a perspective view illustrating a drain pump and a drain hose of the washing machine in accordance with one embodiment.
Figure 3:
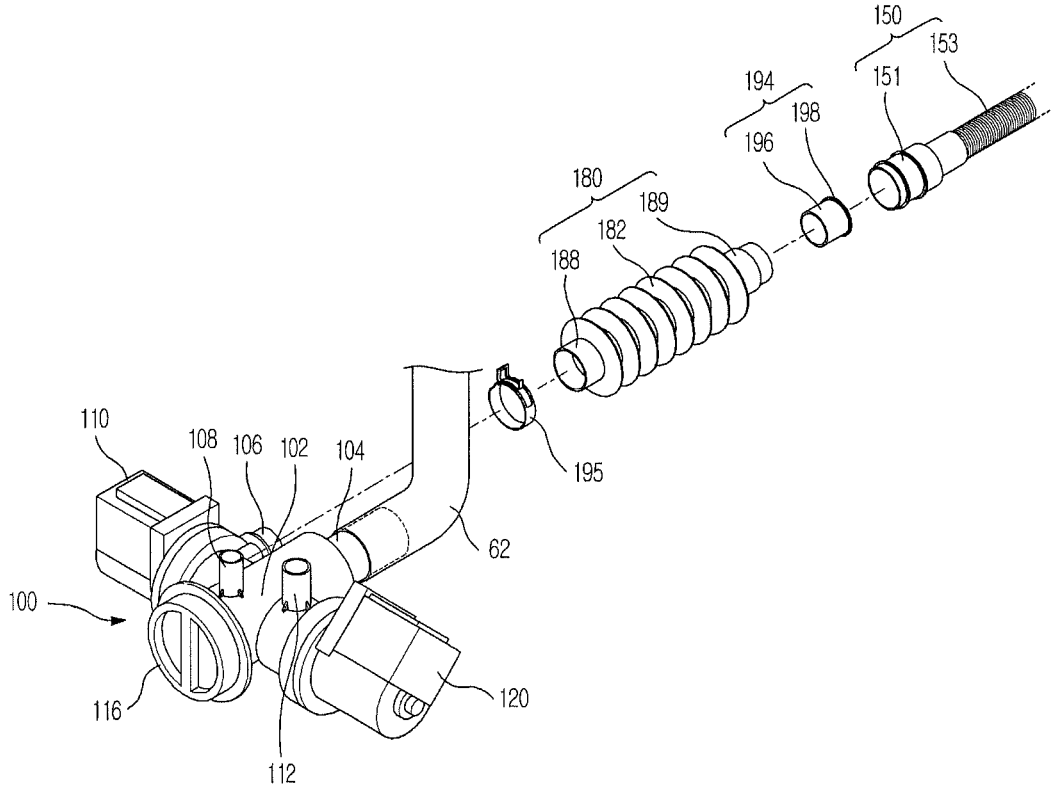
FIG. 3 is an exploded perspective view illustrating the drain pump, the drain hose and an anti-vibration member of FIG. 2.
Figure 4:
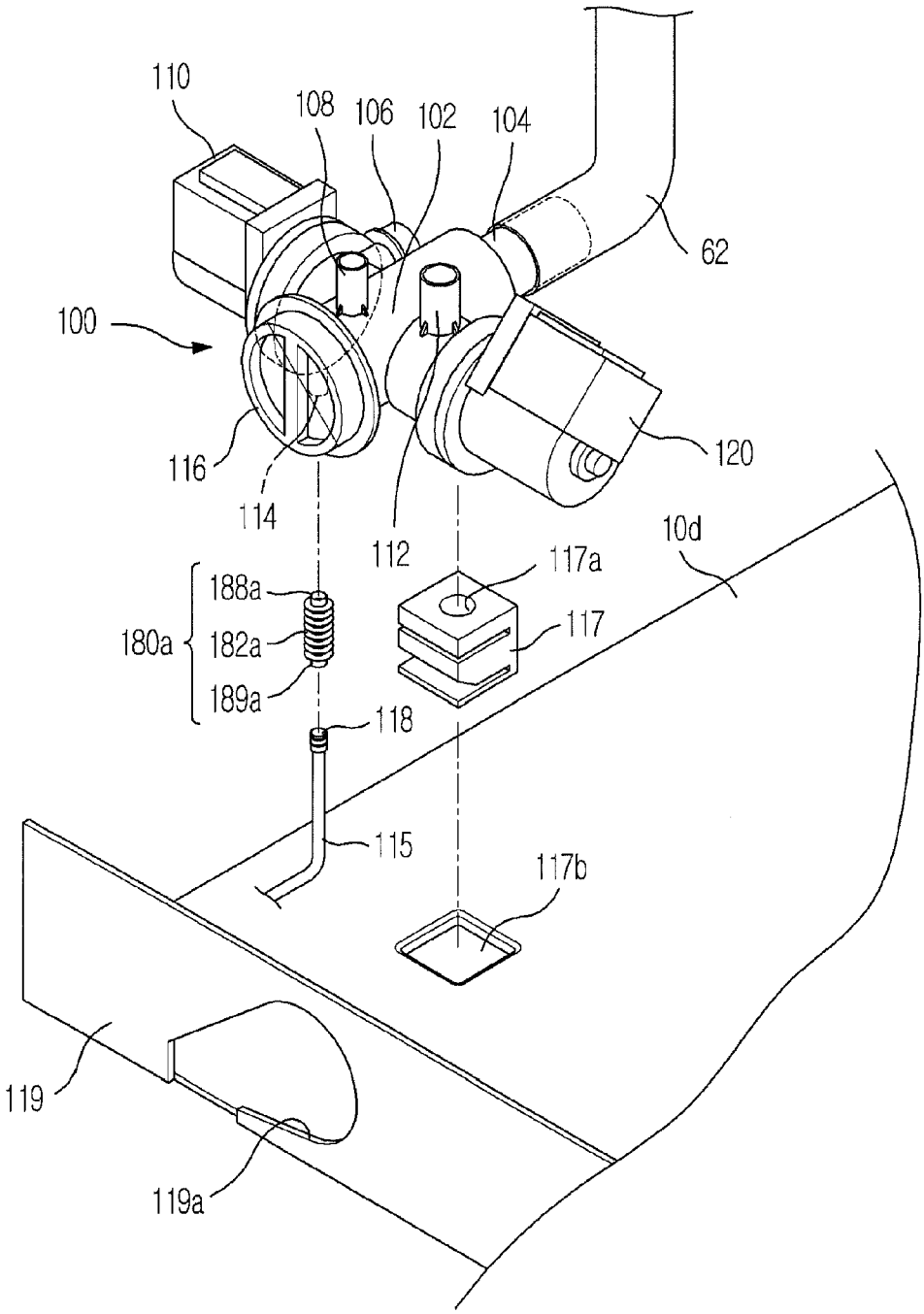
FIG. 4 is an exploded perspective view illustrating connecting relations between the drain pump and front and lower frames of FIG, 2.
Figure 5:
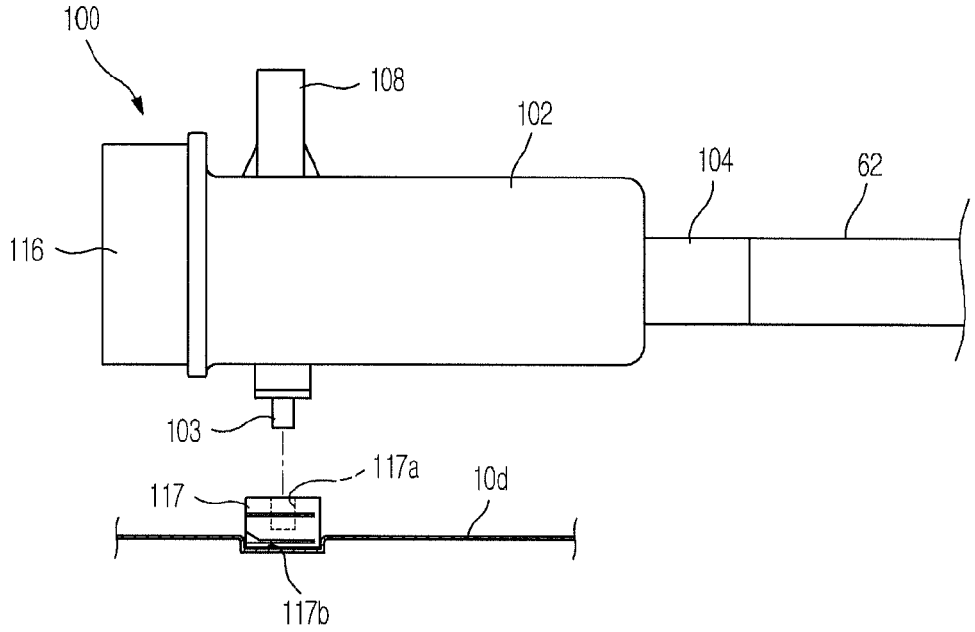
FIG. 5 is a side view of a portion of FIG. 4.
Figure 6:
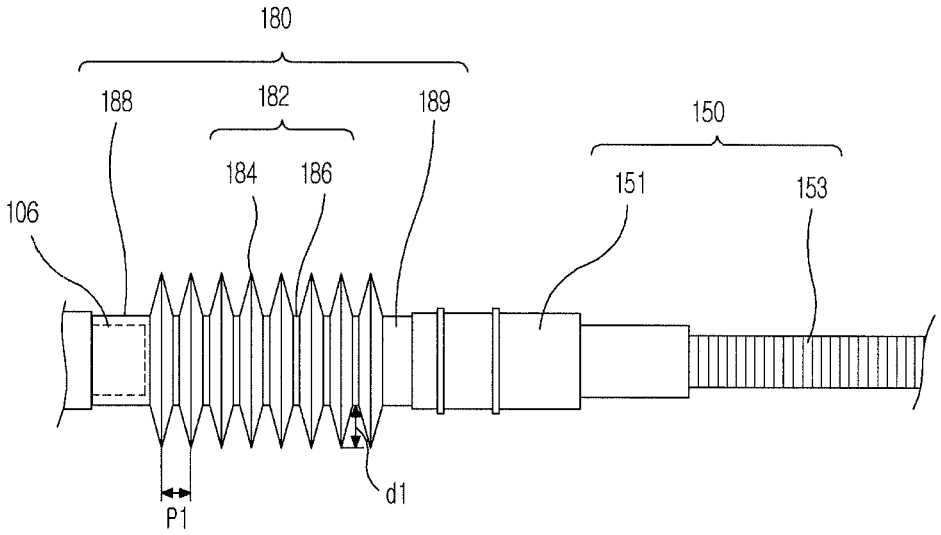
FIG. 6 is a side view illustrating the drain hose and the anti-vibration member of FIG. 3, as seen from the side.

FIG. 2 is a perspective view illustrating a drain pump and a drain hose of the washing machine in accordance with one embodiment, FIG. 3 is an exploded perspective view illustrating the drain pump, the drain hose and an anti-vibration member of FIG. 2, FIG. 4 is an exploded perspective view illustrating connecting relations between the drain pump and the front and lower frames of FIG. 2, FIG. 5 is a side view of a portion of FIG. 4, and FIG. 6 is a side view illustrating the drain hose and the anti-vibration member of FIG. 3, as seen from the side.

As shown in FIGS. 2 to 6, a drain pump 100 to discharge water in the tub 20 to the outside of the cabinet 10, a connection hose 62 connecting the tub 20 to the drain pump 100 to allow the water in the tub 20 to be introduced into the drain pump 100, and a drain hose 150 to guide water pumped by the drain pump 100 to the outside of the cabinet 10 may be provided below the tub 20. Further, an anti-vibration member 180 to prevent vibration of the drain pump 100 from being transmitted to the drain hose 150 is provided between the drain pump 100 and the drain hose 150.

The drain pump 100 may include a pump housing 102 to accommodate wash water, a drain motor 110 connected to one end of the pump housing 102 and providing power to forcibly drain wash water introduced into the pump housing 102, and a bubble generating motor 120 to generate bubbles in wash water during a process of circulating the wash water accommodated in the pump housing 102 to the inside of the tub 20.

The pump housing 102 may include a wash water inlet 104 through which wash water in the tub 20 is introduced into the pump housing 102, a wash water outlet 106 to discharge the wash water introduced into the pump housing 102, an air outlet 108 to discharge air in the pump housing 102, a wash water circulation hole 112 to guide the wash water introduced into the pump housing 102 to circulate the wash water back to the tub 20, and a remaining water outlet 114 to discharge water remaining in the pump housing 102. A remaining water hose 115 may be connected to the remaining water outlet 114, thus guiding the remaining water having passed through the remaining water outlet 114 to the outside of the washing machine 1.

The wash water inlet 104 may be connected to the tub 20 through the connection hose 62, thereby allowing the wash water in the tub 20 to be introduced into the pump housing 102. The wash water outlet 106 may serve to discharge the wash water in the pump housing 102 to the outside of the cabinet 10 through the drain hose 150. The air outlet 108 may serve to discharge air mixed with the wash water during pumping of the wash water by the drain pump 100 to the outside of the pump housing 102. The remaining water outlet 114 may extend downwards from one side of the pump housing 102, thereby naturally draining wash water remaining in the pump housing 102 after drain of the wash water through the drain pump 100 has been completed.

The drain pump 100 may be disposed such that a filter 116 is exposed from the front surface of the washing machine 1. A pump connection frame 119 to which the drain pump 100 may be connected may be provided on the front frame 10*a* forming the front surface of the washing machine 1. The pump connection frame 119 may have a rectangular shape having a designated width, and may be provided with a through hole 119*a* formed on the front surface thereof to expose the filter 116 of the drain pump 100. The remaining water hose 115 may protrude from the front surface of the pump connection frame 119 through the through hole 119*a*.

Further, a user may grip the filter 116 exposed through the through hole 119*a*, thereby possibly being capable of easily replacing the filter 116.

The pump housing 102 may be connected to the lower frame 10*d* through a mount member 117. A connection hole 117*a* to accommodate a connection protrusion 103, which may be formed on the lower portion of the pump housing 102, may be formed on the upper surface of the mount member 117. The pump housing 102 and the mount member 117 may be connected to each other by fitting the connection protrusion 103 into the connection hole 117*a*. Further, the mount member 117 may be connected to the lower frame 10*d* through a connection recess 117*b* formed on the lower frame 10*d*.

The mount member 117 may be formed of a material, such as rubber or plastic, may be located between the pump housing 102 and the lower frame 10*d*, and may absorb vibration of the pump housing 102, thus possibly preventing the vibration of the pump housing 102 from being transmitted to the lower frame 10*d*.

The anti-vibration member 180 may be connected to the wash water outlet 106 of the pump housing 102.

The anti-vibration member 180 connected to the wash water outlet 106 of the pump housing 102 may prevent vibration, generated from the drain pump 100 during operation of the drain pump 100, from being transmitted to the drain hose 150 or the front frame 10*a*. The anti-vibration member 180 may include a corrugation part 182 to absorb the vibration of the drain pump 100, a first connection part 188 extending from one end of the corrugation part 182 and connected to the wash water outlet 106, and a second connection part 189 extending from the other end of the corrugation part 182 and connected to one end of the drain hose 150.

The corrugation part 182 may have a structure in which mountain-shaped portions 184 and valley-shaped portions 186 are alternately disposed, and may be hollowed so that wash water moves within the corrugation part 182. The mountain-shaped portions 184 and the valley-shaped portions 186 may enable the external shape of the corrugated part 182 to be easily deformed when external energy, such as vibration, is transmitted to the corrugation part 182, thereby possibly allowing the corrugation part 182 to effectively absorb the external energy. In order to effective absorb the external energy, an interval P1 between the mountain-shaped portions 184 may be more than 10 mm, and a difference d1 of widths in the circumferential direction between the mountain-shaped portion 184 and the valley-shaped portion 186 may be more than 5 mm.

The corrugation part 182 may absorb vibration generated due to influence of inertial moment according to the center of gravity of the drain pump 100 including the pump housing 102, the drain motor 110 and the bubble generating motor 120 during operation of the drain motor 110 to drain wash water or operation of the bubble generating motor 120 to generate bubbles in wash water. In more detail, when vibration energy generated from the drain pump 100 is transmitted to the corrugation part 182, the vibration energy may be converted into heat energy or sound energy generated due to friction between the mountain-shaped portions 184 and the valley-shaped portions 186 while the external shape of the corrugation part 182 is deformed, and thus may be absorbed by the corrugation part 182.

The first connection part 188 may extend from one end of the corrugation part 182 to a designated length and may be connected to the wash water outlet 106. The first connection part 188 may be provided such that the inner circumferential surface of the first connection part 188 may contact the outer circumferential surface of the wash water outlet 106. In order to fix the first connection part 188 and the wash water outlet 106 to each other without separation and to prevent water leakage between the first connection part 188 and the wash water outlet 106, a clamp 195 may be connected to the outer circumferential surface of the first connection part 188 under the condition that the first connection part 188 and the wash water outlet 106 are connected to each other.

The second connection part 189 may extend from the other end of the corrugation part 182 to a designated distance and may be connected to the drain hose 150. The second connection part 189 may be provided such that the outer circumferential surface of the second connection part 189 may be inserted into the inner circumferential surface of one end of the drain hose 150, and may be connected to the end of the drain hose 150 by heat fusion under the condition that the outer circumferential surface of the second connection part 189 is inserted into the inner circumferential surface of the end of the drain hose 150. The anti-vibration member 180 and the drain hose 150 may be integrated into one body through heat fusion between the second connection part 189 and the end of the drain hose 150, and the anti-vibration member 180 and the drain hose 150 integrated into one body may be connected to the drain pump 100.

The anti-vibration member 180 may be used in common by adjusting the sizes (diameters) of the first connection part 188 and the second connection part 189 of the anti-vibration member 180 to be fit into standards of the wash water outlet 106 of the drain pump 100 and the drain hose 150 used in the washing machine 1.

A sleeve 194 may be connected to the inner circumferential surface of the second connection part 189. The sleeve 194 may include an insertion part 196 inserted into the second connection part 189 to reinforce the second connection part 189, and a latching part 198 formed at the end of the insertion part 196 to restrict a depth of the sleeve 194 inserted into the second connection part 189.

As described above, in order to possibly effectively absorb vibration of the drain pump 100, the anti-vibration member 180 may include the corrugation part 182, and the shape of the corrugation part 182 may be easily deformed to possibly absorb vibration of the drain pump 100. If the thickness of the corrugation part 182 is increased, stiffness of the corrugation part 182 is increased and thus the shape of the corrugation part 182 may not be easily deformed and the corrugation part 182 may not completely absorb vibration of the drain pump 100. In order to possibly exhibit effective vibration absorption performance, the thickness of the corrugation part 182 may be less than about 2 mm, and the thickness of the second connection part 189 formed integrally with the corrugation part 182 may be less than about 2 mm.

If the thickness of the second connection part 189 is less than 2 mm, the cross-sectional shape of the second connection part 189 may not be completely round and may be distorted, and if the cross-sectional shape of the second connection part 189 is distorted, the outer circumferential surface of the second connection part 189 may not completely contact the inner circumferential surface of one end of the drain hose 150 during heat fusion between the second connection part 189 and the end of the drain hose 150, and thus connection strength therebetween may be lowered and water leakage therebetween may occur. The insertion part 196 inserted into the second connection part 189 may reinforce the second connection part 189 and may allow the second connection part 189 to have the completely round cross section, thereby enabling heat fusion between the second connection part 189 and the drain hose 150 under the condition that the second connection part 189 completely contacts the end of the drain hose 150.

The latching part 198 may have a shape bent outwards from one end of the insertion part 196, and may allow the sleeve 194 to be latched to one end of the second connection part 189.

Since the sleeve 194 may be connected to the inner circumferential surface of the second connection part 189 and may serve to reinforce the second connection part 189, the sleeve 194 may be referred to as a strength reinforcing member.

The anti-vibration member 180 may be formed of an injection molded product of plastic having high vibration isolating characteristics, such as, for example, thermoplastic elastomer (TPE), thermoplastic olefinic elastomer (TPO), thermoplastic polyurethane (TPU), thermoplastic polyamide (TPAE) and thermoplastic polyester elastomer (TPEE), or rubber, such as ethylene propylene diene M-class (EPDM). The anti-vibration member 180 formed of plastic or rubber may effectively absorb vibration energy generated from the drain pump 100 through flexible shape deformation.

The drain hose 150 may be connected to the second connection part 189. The drain hose 150 may include a hose corrugation part 153 extensible in the lengthwise direction of the drain hose 150, and an extension part 151 extending from one end of the hose corrugation part 153. The hose corrugation part 153 may allow the drain hose 150 to be flexibly bent, and thus may prevent the drain hose 150 from being easily damaged even if external vibration or impact is applied to the drain hose 150 while wash water flows within the drain hose 150. Further, the hose corrugation part 153 may allow the drain hose 150 to be easily mounted on the inner portion of the cabinet 10. The extension part 151 may be connected to the second part 189 of the anti-vibration member 180 by heat fusion. The drain hose 150 may be formed of a material having higher stiffness than the material of the anti-vibration member 180, such as, for example, polypropylene (PP).

The anti-vibration member 180 may be provided between the pump housing 102 and the drain hose 150 and may absorb vibration of the pump 100, thereby possibly reducing vibration noise generated due to transmission of vibration of the pump 100 to the drain hose 150 and contact between the drain hose 150 and the frames 10*b*, 10*c* and 10*d*, and possibly reducing vibration noise generated due to direct transmission of vibration of the pump 100 disposed at the lower portion of the front surface of the cabinet 10 to the front frame 10*a*, as shown in FIG. 2.

The drain hose 150 may be connected to the inner portion of the cabinet 10 by a hose wire 172, a hose holder 174, etc. so as possibly not to interfere with other parts in the cabinet 10, and may be guided to the outside of the cabinet 10 by a hose guide 176.

An anti-vibration pad 210 may be provided on the inner surface of at least one of the front frame 10*a*, the rear frame 10*b*, the side frames 10*c* and the lower frame 10*d* of the cabinet 10. The anti-vibration pad 210 may prevent the drain hose 150 from directly contacting the frames 10*a*, 10*b*, 10*c* and 10*d* by vibration of the drain pump 100, thereby possibly reducing vibration noise generated due to contact of the drain hose 150 with the frames 10*a*, 10*b*, 10*c* and 10*d*.

An anti-vibration member 180*a* may be connected between the remaining water outlet 114 of the pump housing 102 and the remaining water hose 115.

The anti-vibration member 180*a* connected to the remaining water outlet 114 of the pump housing 102 may prevent vibration, generated from the drain pump 100 during operation of the drain pump 100, from being transmitted to the remaining water hose 115. The anti-vibration member 180*a* may include a corrugation part 182*a* to absorb the vibration of the drain pump 100, a first connection part 188*a* extending from one end of the corrugation part 182*a* and connected to the remaining water outlet 114, and a second connection part 189*a* extending from the other end of the corrugation part 182*a* and connected to one end of the remaining water hose 115.

The anti-vibration member 180*a* may prevent vibration of the drain pump 100 from being transmitted to the front frame 10*a* of the washing machine 1. As described above, the remaining water hose 115 may protrude from the front surface of the pump connection frame 119 through the through hole 119*a* of the pump connection frame 119 connected to the front frame 10*a* when the drain pump 100 is operated, and if the anti-vibration member 180*a* is not used, vibration generated due to operation of the drain pump 100 may be transmitted to the remaining water hose 115, the remaining water hose 115 itself may move and irregularly contact the through hole 119*a* to generate contact noise, or movement of the remaining water hose 115 may be transmitted to the through hole 119*a*, the pump connection frame 119 and the front frame 10*a* to generate vibration noise. The anti-vibration member 180*a* may absorb vibration of the drain pump 100, thus possibly preventing vibration of the drain pump 100 from being transmitted to the remaining water hose 115.

The principle of absorbing vibration of drain pump 110 through the corrugation part 182*a* of the anti-vibration member 180*a* is the same as the above-described principle of absorbing vibration of the drain pump 110 through the corrugation part 182 of the anti-vibration member 180 connected to the drain hose 150, and thus a detailed description thereof will be omitted.

Figure 7A:
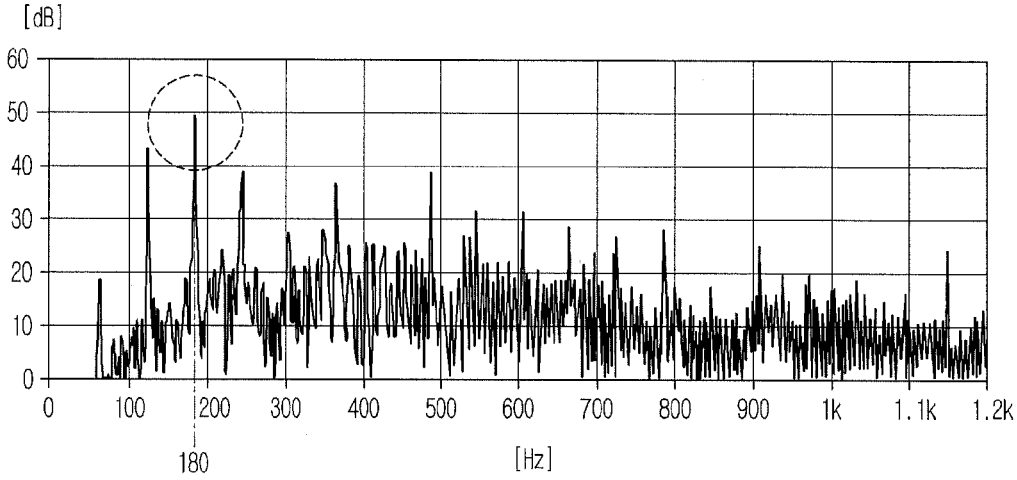
FIGS. 7A and 7B are graphs comparing noise of the washing machine if the anti-vibration member is used and if the anti-vibration member is not used.
Figure 7B:
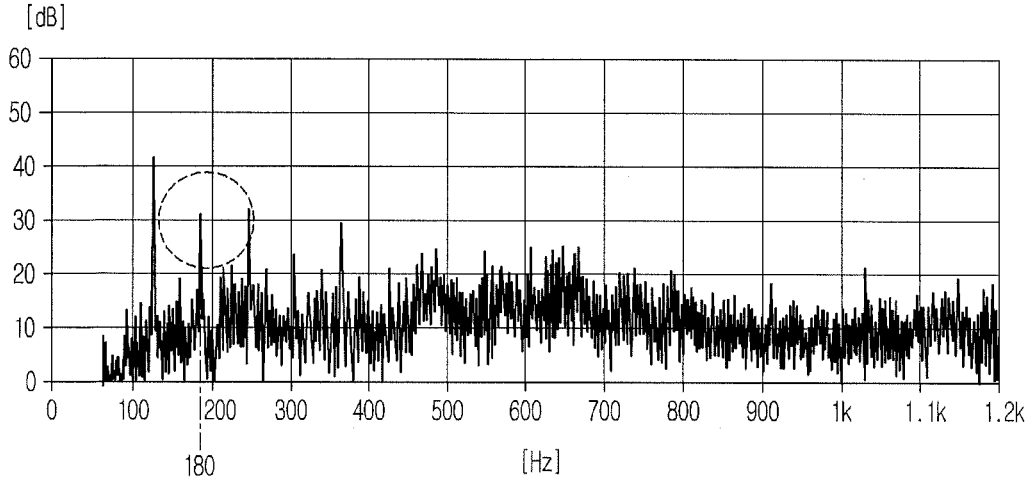

FIGS. 7A and 7B are graphs comparing noise of the washing machine if the anti-vibration member is used and if the anti-vibration member is not used, particularly, comparing drain noise of the washing machine from when wash water in the tub 20 reaches a half of the full level to when the wash water in the tub 20 is completely drained, i.e., in a section in which vibration of the drain pump 100 itself is generally high. In the graphs, the horizontal axis represents a frequency Hz of noise generated due to vibration of the drain pump 100, and the vertical axis represents a noise level (dB) of the corresponding frequency.

As shown in FIGS. 7A and 7B, it is understood that noise generated if the drain pump 100 is operated under the condition that the drain pump 100 and the drain hose 150 are connected by the anti-vibration member 180 may be reduced, as compared to noise generated if the drain pump 100 is operated under the condition that the drain hose 150 is directly connected to the drain pump 100 without the anti-vibration member 180. Particularly, noise at a frequency of 180 Hz may correspond to noise generated when vibration of the drain pump 100 is transmitted to the drain hose 150 and thus the drain hose 150 contacts the cabinet 10. Since noise at a frequency of 180 Hz if the anti-vibration member 180 is used may be greatly decreased by 20 dB or more, it is understood that vibration of the drain pump 100 may be absorbed by the anti-vibration member 180 and thus is not transmitted to the drain hose 150.

Although not shown in the drawings, the anti-vibration member 180 may be connected to a drain pump used in a washing machine using a pulsator as well as a drum washing machine so as to possibly absorb vibration.

Hereinafter, a dish washer in accordance with another embodiment will be described.

Figure 8:
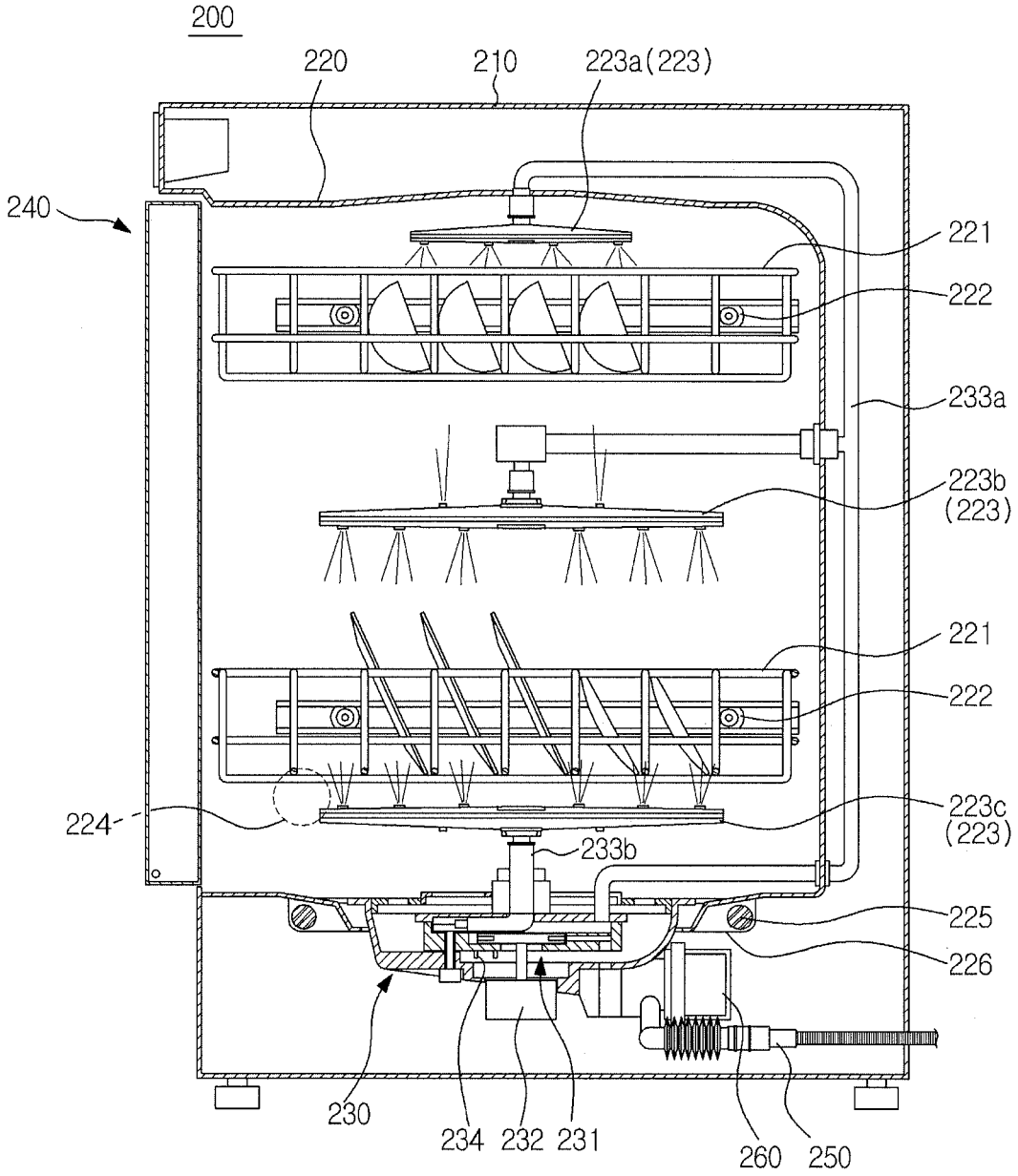
FIG. 8 is a sectional view illustrating the configuration of a dish washer in accordance with another embodiment.

FIG. 8 is a sectional view illustrating the configuration of the dish washer in accordance with this embodiment.

As shown in FIG. 8, a dish washer 200 in accordance with this embodiment may include a case 210, a washing tub 220 provided in the case 210 and forming a washing space, a sump 230 provided under the washing tub 220 and storing wash water, and a door 240 to open and close the front surface of the washing tub 220.

The washing tub 220 may include at least one dish basket 221 to accommodate dishes, at least one rack 222 slidably supporting the at least one dish basket 221, and at least one spray nozzle 223 to spay wash water. Here, the at least one spray nozzle 223 may include a top nozzle 223*a*, an upper nozzle 223*b* and a lower nozzle 223*c*.

A water supply unit 224 to supply wash water may be formed in the washing tub 220. The water supply unit 224 may be provided on the side wall of the washing tub 220. Wash water may be supplied to the inside of the washing tub 220 through the water supply unit 224.

A heater 225 to heat wash water and a heater installation groove 226 may be installed on the washing tub 220. The heater installation groove 226 may be provided on the bottom of the washing tub 220, and the heater 225 may be installed in the heater installation groove 226.

The sump 230 may be provided at the center of the bottom of the washing tub 220 so as to collect and pump wash water. The sump 230 may include a washing pump 231 to pump wash water at a high pressure, and a pump motor 232 to drive the washing pump 231. The washing pump 231 may pump wash water to the top nozzle 223*a* and the upper nozzle 223*b* through a first supply pipe 233*a*, and pumps wash water to the lower nozzle 223*c* through a second supply pipe 233*b*.

The sump 230 may include a turbidity sensor 234 to detect a pollution level of wash water. A control unit (not shown) of the dish washer 201 may detect a pollution level of wash water using the turbidity sensor 234, and control the number of times of a washing operation or a rinsing operation. That is, if the pollution level of wash water is high, the control unit may increase the number of times of the washing operation or the rinsing operation, and if the pollution level of wash water is low, the control unit may decrease the number of times of the washing operation or the rinsing operation.

Further, a drain pump 260 to discharge polluted wash water to the outside of the dish washer 201 may be provided at one side of the sump 230.

The door 240 may be rotatably connected to the case 210 to open and close the front surface of the washing tub 220. A circulation duct (not shown) and various electronic parts (not shown) may be installed in the inner space of the door 240.

Figure 9:
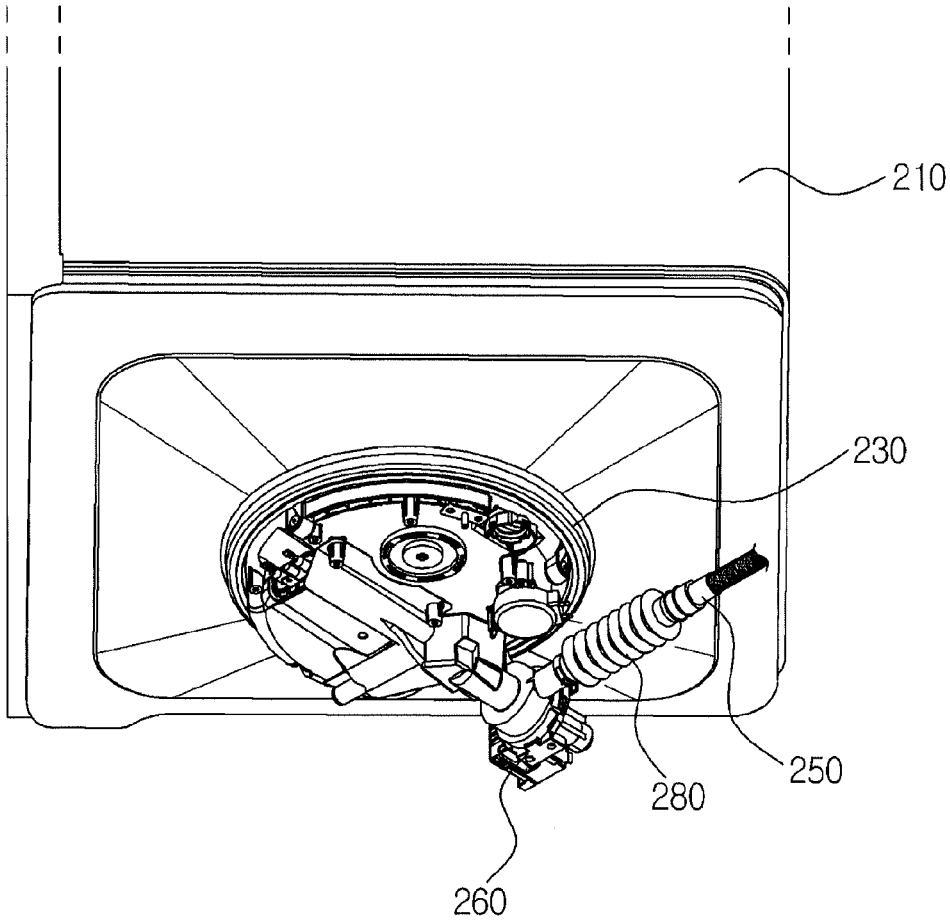
FIG. 9 is a perspective view illustrating a drain pump and a drain hose of the dish washer in accordance with one embodiment.
Figure 10:
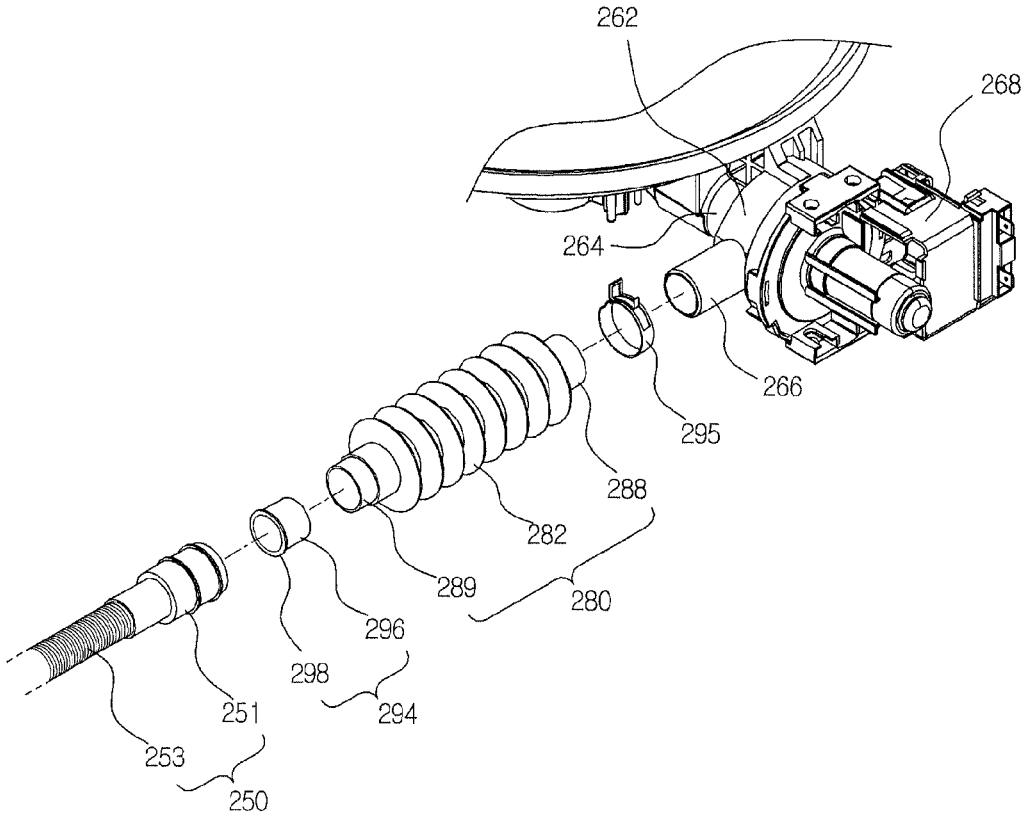
FIG. 10 is a perspective view illustrating the drain pump, the drain hose and an anti-vibration member of the dish washer in accordance with one embodiment.
Figure 11:
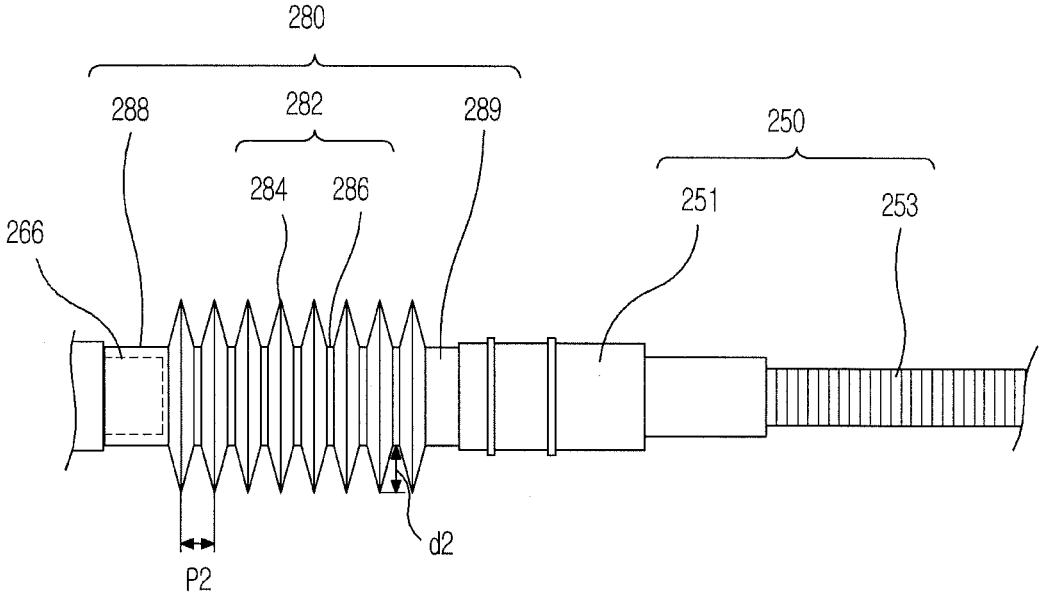
FIG. 11 is a side view illustrating the drain hose and the anti-vibration member of FIG. 10, as seen from the side.

FIG. 9 is a perspective view illustrating the drain pump and a drain hose of the dish washer in accordance with one embodiment, FIG. 10 is a perspective view illustrating the drain pump, the drain hose and an anti-vibration member of the dish washer in accordance with one embodiment, and FIG. 11 is a side view illustrating the drain hose and the anti-vibration member of FIG. 10, as seen from the side.

As shown in FIGS. 9 to 11, the drain pump 260 to discharge water in the washing tub 220 to the outside of the dish washer 201 and a drain hose 250 to guide water pumped by the drain pump 260 to the outside of the dish washer 201 may be provided below the washing tub 220. Further, an anti-vibration member 280 possibly preventing vibration of the drain pump 260 from being transmitted to the drain hose 250 may be provided between the drain pump 260 and the drain hose 250.

The drain pump 260 may include a pump housing 262 to accommodate wash water, and a drain motor 268 providing power to forcibly drain wash water introduced into the pump housing 262. The pump housing 262 may include a wash water inlet 264 through which wash water in the sump 230 may be introduced into the pump housing 262, and a wash water outlet 266 to discharge the wash water introduced into the pump housing 262.

The wash water outlet 266 may discharge the wash water in the pump housing 262 to the outside of the dish washer 201 through the drain hose 250.

The drain pump 260 may be formed integrally with the sump 230. That is, the drain pump 260 may be formed integrally with the sump 230 during injection molding of the sump 230.

The anti-vibration member 280 may be connected to the wash water outlet 266 of the pump housing 262.

The anti-vibration member 280 connected to the wash water outlet 266 of the pump housing 262 may prevent vibration, generated from the drain pump 260 during operation of the drain pump 260, from being transmitted to the drain hose 250. The anti-vibration member 280 may include a corrugation part 282 to absorb the vibration of the drain pump 260, a first connection part 288 extending from one end of the corrugation part 282 and connected to the wash water outlet 266, and a second connection part 289 extending from the other end of the corrugation part 282 and connected to one end of the drain hose 250.

The corrugation part 282 may have a structure in which mountain-shaped portions 284 and valley-shaped portions 286 are alternately disposed, and may be hollowed so that wash water moves within the corrugation part 282. The mountain-shaped portions 284 and the valley-shaped portions 286 may enable the external shape of the corrugated part 282 to be easily deformed when external energy, such as vibration, is transmitted to the corrugation part 282, thereby possibly allowing the corrugation part 282 to effectively absorb the external energy. In order to effectively absorb the external energy, an interval P2 between the mountain-shaped portions 284 may be more than 10 mm, and a difference d2 of widths in the circumferential direction between the mountain-shaped portion 284 and the valley-shaped portion 286 may be more than 5 mm.

The corrugation part 282 may absorb vibration generated during operation of the drain pump 260 to drain wash water. In more detail, when vibration energy generated from the drain pump 260 is transmitted to the corrugation part 282, the vibration energy may be converted into heat energy or sound energy generated due to friction between the mountain-shaped portions 284 and the valley-shaped portions 286 while the external shape of the corrugation part 282 is deformed, and is thus may be absorbed by the corrugation part 282.

The first connection part 288 may extend from one end of the corrugation part 282 to a designated length and may be connected to the wash water outlet 266. The first connection part 288 may be provided such that the inner circumferential surface of the first connection part 288 may contact the outer circumferential surface of the wash water outlet 266. In order to fix the first connection part 288 and the wash water outlet 266 to each other without separation and to prevent water leakage between the first connection part 288 and the wash water outlet 266, a clamp 295 may be connected to the outer circumferential surface of the first connection part 288 under the condition that the first connection part 288 and the wash water outlet 266 are connected to each other.

The second connection part 289 may extend from the other end of the corrugation part 282 to a designated distance and may be connected to the drain hose 250. The second connection part 289 may be provided such that the outer circumferential surface of the second connection part 289 may be inserted into the inner circumferential surface of one end of the drain hose 250, and may be connected to the end of the drain hose 250 by heat fusion under the condition that the outer circumferential surface of the second connection part 289 is inserted into the inner circumferential surface of the end of the drain hose 250. The anti-vibration member 280 and the drain hose 250 may be integrated into one body through heat fusion between the second connection part 289 and the end of the drain hose 250, and the anti-vibration member 280 and the drain hose 250 integrated into one body may be connected to the drain pump 260.

The anti-vibration member 280 may be used in common by adjusting the sizes (diameters) of the first connection part 288 and the second connection part 289 of the anti-vibration member 280 to be fit into standards of the wash water outlet 266 of the drain pump 260 and the drain hose 250 used in the dish washer 201.

A sleeve 294 may be connected to the inner circumferential surface of the second connection part 289. The sleeve 294 may include an insertion part 296 inserted into the second connection part 289 to reinforce the second connection part 289, and a latching part 298 formed at the end of the insertion part 296 to restrict a depth of the sleeve 294 inserted into the second connection part 289.

As described above, in order to possibly effectively absorb vibration of the drain pump 260, the anti-vibration member 280 may include the corrugation part 282, and the shape of the corrugation part 282 may be easily deformed to absorb vibration of the drain pump 260. If the thickness of the corrugation part 282 is increased, stiffness of the corrugation part 282 may be increased and thus the shape of the corrugation part 282 may not be easily deformed and the corrugation part 282 may not completely absorb vibration of the drain pump 260. In order to possibly exhibit effective vibration absorption performance, the thickness of the corrugation part 282 may be less than about 2 mm, and the thickness of the second connection part 289 formed integrally with the corrugation part 282 may be less than about 2 mm.

If the thickness of the second connection part 289 is less than 2 mm, the cross-sectional shape of the second connection part 289 may not be completely round and may be distorted, and if the cross-sectional shape of the second connection part 289 is distorted, the outer circumferential surface of the second connection part 289 may not completely contact the inner circumferential surface of one end of the drain hose 20 during heat fusion between the second connection part 289 and the end of the drain hose 250, and thus connection strength therebetween may be lowered and water leakage therebetween may occur. The insertion part 296 inserted into the second connection part 289 may reinforce the second connection part 289 and allow the second connection part 289 to have a completely round cross section, thereby possibly enabling heat fusion between the second connection part 289 and the drain hose 250 under the condition that the second connection part 289 completely contacts the end of the drain hose 250.

The latching part 298 may have a shape bent outwards from one end of the insertion part 296, and allow the sleeve 294 to be latched to one end of the second connection part 289.

Since the sleeve 294 may be connected to the inner circumferential surface of the second connection part 289 and serve to reinforce the second connection part 289, the sleeve 294 may be referred to as a strength reinforcing member.

The anti-vibration member 280 may be formed of an injection molded product of plastic having high vibration isolating characteristics, such as, for example, thermoplastic elastomer (TPE), thermoplastic olefinic elastomer (TPO), thermoplastic polyurethane (TPU), thermoplastic polyamide (TPAE) and thermoplastic polyester elastomer (TPEE), or rubber, such as ethylene propylene diene M-class (EPDM). The anti-vibration member 280 formed of plastic or rubber may effectively absorb vibration energy generated from the drain pump 250 through flexible shape deformation.

The drain hose 250 may be connected to the second connection part 289. The drain hose 250 may include a hose corrugation part 253 extensible in the lengthwise direction of the drain hose 250, and an extension part 251 extending from one end of the hose corrugation part 253. The hose corrugation part 253 may allow the drain hose 250 to be flexibly bent, and thus possibly prevents the drain hose 250 from being easily damaged even if external vibration or impact is applied to the drain hose 150 while wash water flows within the drain hose 250. The extension part 251 may be connected to the second part 289 of the anti-vibration member 280 by heat fusion. The drain hose 250 may be formed of a material having higher stiffness than the material of the anti-vibration member 280, such as, for example, polypropylene (PP).

The anti-vibration member 280 may be provided between the pump housing 262 and the drain hose 250 and may absorb vibration of the pump 260, thereby possibly reducing vibration noise generated due to transmission of vibration of the pump 260 to the drain hose 250 and interference between the drain hose 250 and the case 210.

Figure 12A:
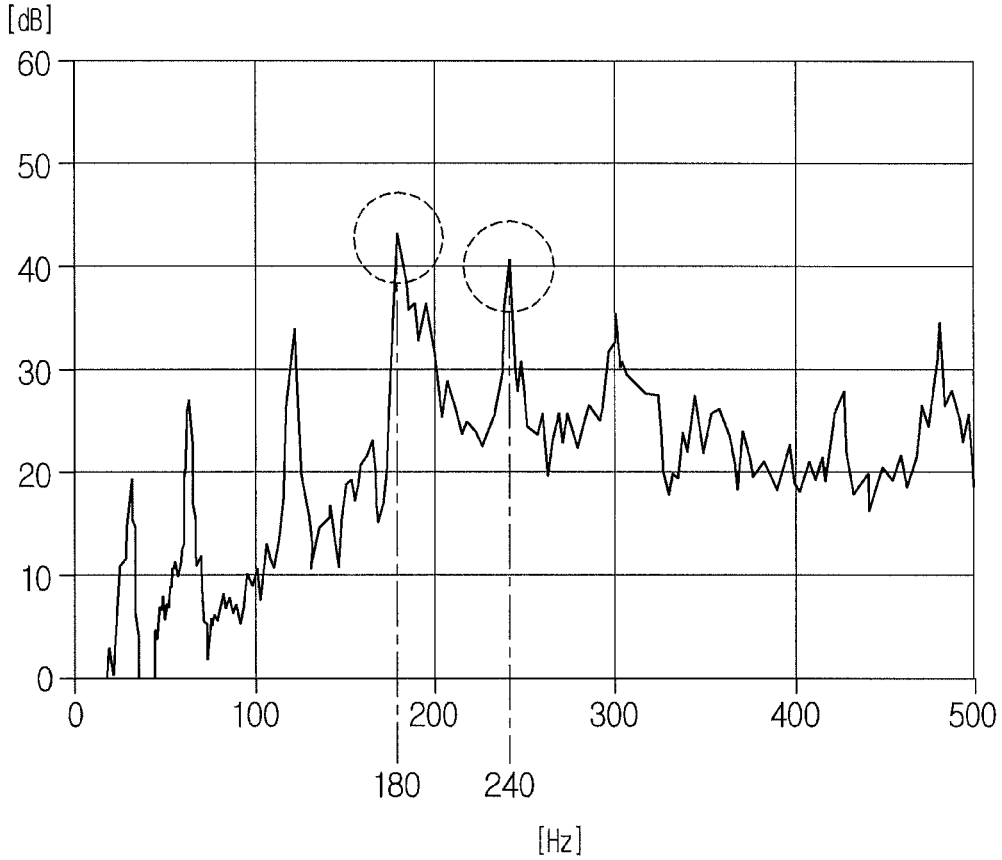
FIGS. 12A and 12B are graphs comparing noise of the dish washer if the anti-vibration member is used and if the anti-vibration member is not used.
Figure 12B:
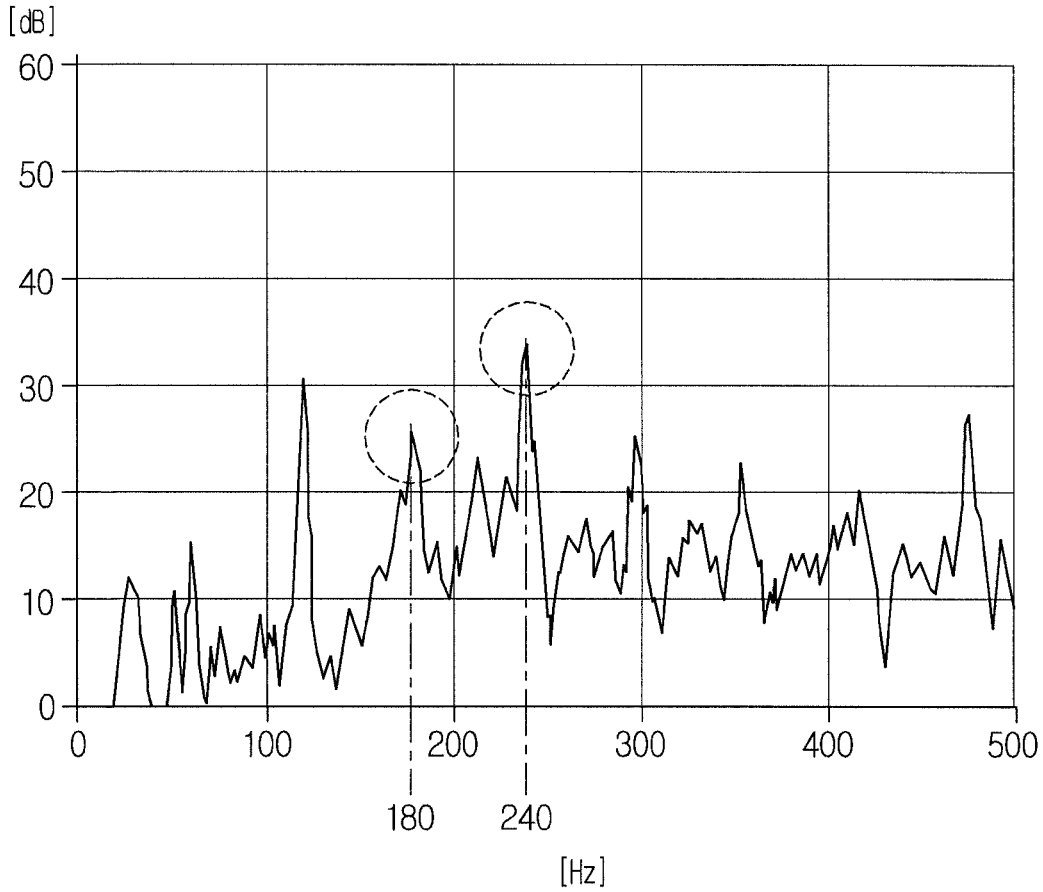

FIGS. 12A and 12B are graphs comparing noise of the dish washer if the anti-vibration member is used and if the anti-vibration member is not used, particularly, comparing drain noise of the dish washer from when wash water in the sump 230 reaches a half of the full level to when the wash water in the sump 230 is completely drained, i.e., in a section in which vibration of the drain pump 260 itself is generally high. In the graphs, the horizontal axis represents a frequency Hz of noise generated due to vibration of the drain pump 260, and the vertical axis represents a noise level (dB) of the corresponding frequency.

As shown in FIGS. 12A and 12B, it is understood that noise generated if the drain pump 260 is operated under the condition that the drain pump 260 and the drain hose 250 are connected by the anti-vibration member 280 may be reduced, as compared to noise generated if the drain pump 260 is operated under the condition that the drain hose 250 is directly connected to the drain pump 260 without the anti-vibration member 280. Particularly, noise at frequencies of 180 Hz and 240 Hz corresponds to noise generated when vibration of the drain pump 260 is transmitted to the drain hose 250 and thus the drain hose 250 collides with the case 210. Since noise at frequencies of 180 Hz and 240 Hz if the anti-vibration member 280 is used may be greatly decreased by 10 dB or more, it is understood that vibration of the drain pump 250 may be absorbed by the anti-vibration member 280 and thus may not be transmitted to the drain hose 250.

Although the embodiments illustrate the anti-vibration members 180 and 280 as being connected to the drain hoses 150 and 250 to absorb vibration generated from the drain pumps 100 and 260, the configurations of the anti-vibration members 180 and 280 are not limited thereto. That is, the anti-vibration members 180 and 280 may be connected to devices generating vibration to possibly absorb the vibration.

As is apparent from the above description, in accordance with one embodiment, vibration of a drain pump may be effectively absorbed by a drain hose, and thus vibration noise may not be generated.

Further, the drain hose itself may absorb vibration of the drain pump, and thus a separate structure to absorb the vibration may be omitted and production costs are reduced.

Although a few embodiments have been shown and described, it would be appreciated by those skilled in the art that changes may be made in these embodiments without departing from the principles and spirit of the invention, the scope of which is defined in the claims and their equivalents

What is claimed is:

1. A washing machine comprising:

a cabinet including a frame;

a tub disposed within the cabinet to accommodate laundry;

a drain pump to drain wash water in the tub;

a drain hose to guide wash water pumped by the drain pump to the outside of the cabinet; and an anti-vibration member connected between the drain pump and the drain hose, serving as a path along which the wash water is drained, and preventing vibration of the drain pump from being transmitted to the drain hose during drainage of the wash water, wherein the anti-vibration member and the drain hose are formed of different materials, and wherein a stiffness of the drain hose is higher than a stiffness of the anti-vibration member.

2. The washing machine according to claim 1, wherein the anti-vibration member includes:

a first connection part connected to the drain pump and a second connection part connected to the drain hose; and an anti-vibration corrugation part provided between the first connection part and the second connection part.

3. The washing machine according to claim 2, wherein:

the drain pump includes a wash water inlet through which the wash water in the tub is introduced into the drain pump, and a wash water outlet to discharge the wash water introduced into the drain pump; and the first connection part extends from one end of the anti-vibration corrugation part and is connected to the wash water outlet.

4. The washing machine according to claim 3, wherein:

the drain hose includes a hose corrugation part allowing the drain hose to be flexibly bent, and an extension part extending from one end of the hose corrugation part; and the second connection part extends from the other end of the anti-vibration corrugation part and is connected to the extension part.

5. The washing machine according to claim 4, wherein the second connection part and the extension part are connected to each other by heat fusion.

6. The washing machine according to claim 5, wherein the anti-vibration member includes a sleeve connected to the second connection part.

7. The washing machine according to claim 6, wherein the sleeve includes:

an insertion part inserted into the second connection part to reinforce the second connection part; and a latching part formed at the end of the insertion part to restrict a depth of the sleeve inserted into the second connection part.

8. The washing machine according to claim 7, wherein the second connection part is inserted into one end of the drain hose.

9. The washing machine according to claim 8, wherein the anti-vibration member is formed of an injection molded product of plastic or rubber.

10. The washing machine according to claim 2, wherein the anti-vibration member is formed integrally with the drain hose.

11. The washing machine according to claim 4, wherein the first connection part has a size corresponding to the diameter of the wash water outlet and the second connection part has a size corresponding to the diameter of the extension part so as to use the anti-vibration member in common.

12. The washing machine according to claim 1, further comprising:

a remaining water hose to guide wash water remaining in the drain pump to the outside of the cabinet; and an anti-vibration member including a corrugation part connected between the drain pump and the remaining water hose and preventing vibration of the drain pump from being transmitted to the remaining water hose during drainage of the wash water.

13. A washing machine comprising:

a cabinet including a front frame and a rear frame;

a tub disposed within the cabinet to accommodate laundry;

a drain pump disposed below the tub to drain wash water in the tub;

a drain hose to guide the wash water pumped by the drain pump to the outside of the cabinet; and an anti-vibration member formed of a material differing from the drain hose, and including a corrugation part connected between the drain pump and the drain hose and absorbing vibration of the drain pump during drainage of the wash water, wherein a stiffness of the drain hose is higher than a stiffness of the anti-vibration member.

14. The washing machine according to claim 13, wherein the drain pump is disposed closer to the front frame than the rear frame.

15. The washing machine according to claim 14, wherein the anti-vibration member further includes:

a first connection part connected to the drain pump; and a second connection part connected to the drain hose.

16. The washing machine according to claim 15, wherein:

the anti-vibration member further includes a strength reinforcing member connected to the second connection part; and the strength reinforcing member includes:

an insertion part inserted into the second connection part to reinforce the second connection part; and a latching part formed at the end of the insertion part to latch the strength reinforcing member to one end of the second connection part.

17. The washing machine according to claim 16, wherein the anti-vibration member is formed of an injection molded product of plastic or rubber.

18. The washing machine according to claim 13, wherein:

the cabinet further includes side frames and a lower frame connecting the front frame and the rear frame to each other; and the washing machine further includes an anti-vibration pad connected to the inner surface of at least one of the frames to prevent the drain hose from directly contact the frames due to vibration of the drain pump.

19. A dish washer comprising:

a case;

a washing tub disposed in the case to accommodate dishes;

a sump provided under the washing tub;

a drain pump provided at one end of the sump to drain wash water in the sump;

a drain hose to guide the wash water pumped by the drain pump to the outside of the case; and an anti-vibration member connected between the drain pump and the drain hose, serving as a path along which the wash water is drained, and preventing vibration of the drain pump from being transmitted to the drain hose during drainage of the wash water, wherein the anti-vibration member and the drain hose are formed of different materials, and wherein a stiffness of the drain hose is higher than a stiffness of the anti-vibration member.

20. The dish washer according to claim 19, wherein the anti-vibration member includes:

a first connection part connected to the drain pump and a second connection part connected to the drain hose; and an anti-vibration corrugation part provided between the first connection part and the second connection part.

21. The dish washer according to claim 20, wherein:

the drain pump includes a wash water inlet through which the wash water in the sump is introduced into the drain pump, and a wash water outlet to discharge the wash water introduced into the drain pump; and the first connection part extends from one end of the anti-vibration corrugation part and is connected to the wash water outlet.

22. The dish washer according to claim 21, wherein:

the drain hose includes a hose corrugation part allowing the drain hose to be flexibly bent, and an extension part extending from one end of the hose corrugation part; and the second connection part extends from the other end of the anti-vibration corrugation part and is connected to the extension part.

23. The dish washer according to claim 22, wherein the second connection part and the extension part are connected to each other by heat fusion.

24. The dish washer according to claim 23, wherein the anti-vibration member includes a sleeve connected to the second connection part.

25. The dish washer according to claim 24, wherein the sleeve includes:

an insertion part inserted into the second connection part to reinforce the second connection part; and a latching part formed at the end of the insertion part to restrict a depth of the sleeve inserted into the second connection part.

26. The dish washer according to claim 25, wherein the second connection part is inserted into one end of the drain hose.

27. The dish washer according to claim 26, wherein the anti-vibration member is formed of an injection molded product of plastic or rubber.

28. The dish washer according to claim 20, wherein the anti-vibration member is formed integrally with the drain hose.

29. The dish washer according to claim 22, wherein the first connection part has a size corresponding to the diameter of the wash water outlet and the second connection part has a size corresponding to the diameter of the extension part so as to use the anti-vibration member in common.

30. A washer comprising:

a main body;

a drain pump disposed at a lower portion of the main body;

a drain hose to guide wash water pumped by the drain pump to an outside of the main body; and an anti-vibration member formed of a material differing from the drain hose, and including a corrugation part connected between the drain pump and the drain hose and absorbing vibration of the drain pump during drainage of the wash water, wherein a stiffness of the drain hose is higher than a stiffness of the anti-vibration member.

31. The washer according to claim 30, wherein the anti-vibration member includes:

a first connection part connected to the drain pump; and a second connection part connected to the drain hose.

32. The washing machine according to claim 31, wherein:

the body further includes a front frame, a rear frame and side frames and a lower frame connecting the front frame and the rear frame to each other; and the washing machine further includes an anti-vibration pad connected to the inner surface of at least one of the frames to prevent the drain hose from directly contact the frames due to vibration of the drain pump.

* * * * *